US008217564B2

(12) United States Patent
Odell et al.

(10) Patent No.: US 8,217,564 B2
(45) Date of Patent: Jul. 10, 2012

(54) ELECTRODELESS BULB HAVING IMPROVED DIMENSIONS FOR LIGHT EMISSION

(75) Inventors: Edwin Charles Odell, Leicerster (GB); Barry Preston, Melton Mowbray (GB)

(73) Assignee: Ceravision Limited, Milton Keynes (GB)

( * ) Notice: Subject to any disclaimer, the term of this patent is extended or adjusted under 35 U.S.C. 154(b) by 0 days.

(21) Appl. No.: 12/451,443

(22) PCT Filed: May 13, 2008

(86) PCT No.: PCT/GB2008/001657

§ 371 (c)(1), (2), (4) Date: Apr. 9, 2010

(87) PCT Pub. No.: WO2008/139189

PCT Pub. Date: Nov. 20, 2008

(65) Prior Publication Data

US 2010/0219754 A1 Sep. 2, 2010

(30) Foreign Application Priority Data

May 15, 2007 (GB) ..... 0709341.2

(51) Int. Cl.
*H01J 17/46* (2006.01)

(52) U.S. Cl. ..... 313/153; 313/154; 313/160; 315/248; 315/44; 445/26

(58) Field of Classification Search ..... 313/153–162; 445/22, 26–27
See application file for complete search history.

(56) References Cited

U.S. PATENT DOCUMENTS

| | | | | |
|---|---|---|---|---|
| 5,541,475 | A | 7/1996 | Wood | |
| 2001/0035720 | A1 | 11/2001 | Guthrie | |
| 2002/0079845 | A1 * | 6/2002 | Kirkpatrick et al. | 315/248 |
| 2005/0052140 | A1 * | 3/2005 | Park et al. | 313/637 |
| 2007/0075651 | A1 | 4/2007 | Park | |
| 2007/0236127 | A1 * | 10/2007 | DeVincentis et al. | 313/317 |

FOREIGN PATENT DOCUMENTS

| | | | |
|---|---|---|---|
| DE | 24 26 662 | | 1/1975 |
| EP | 1 056 118 | A | 11/2000 |
| JP | 10 106508 | | 4/1998 |
| WO | WO 2006/129102 | A | 12/2006 |

* cited by examiner

*Primary Examiner* — Tracie Y Green
(74) *Attorney, Agent, or Firm* — Bay State IP, LLC; Adam J. Bruno

(57) ABSTRACT

An electrodeless bulb has a hollow quartz tube, with a solid stem extending from one end and a short hollow tip extending from the other end. The hollow interior of the tube extends into the tip with the same diameter as in the tube, but the wall thickness of the tip is reduced from that of the tube. The bulb is charged with an amount of indium bromide and traces of other metal halides to adjust light spectrum and a filling of xenon gas.

19 Claims, 1 Drawing Sheet

ELECTRODELESS BULB HAVING IMPROVED DIMENSIONS FOR LIGHT EMISSION

CROSS REFERENCE TO RELATED APPLICATION

This application is for entry into the U.S. National Phase under §371 for International Application No. PCT/GB2008/001657 having an international filing date of May 13, 2008, and from which priority is claimed under all applicable sections of Title 35 of the United States Code including, but not limited to, Sections 120, 363 and 365(c), and which in turn claims priority under 35 USC 119 to U.K. Patent Application No. 0709341.2 filed on May 15, 2007.

BACKGROUND OF THE INVENTION

The present invention relates to an electrodeless bulb.

DESCRIPTION OF THE RELATED ART

In our International Patent Application No PCT/GB05/005080, dated 23 Dec. 2005 and now published under No WO 2006/070190, we have described and claimed a method of making an electrodeless bulb, the method comprising the steps of:

providing a bulb enclosure of quartz glass, forming an adjacent neck having a bore less than a transverse internal dimension of the bulb enclosure either:

integrally with the bulb enclosure or in a branch tube opening into the bulb enclosure, inserting at least one pellet of excitable material into the bulb enclosure through the adjacent neck, evacuating the bulb enclosure through the adjacent neck and sealing the bulb.

Normally the bulb is back filled with inert gas.

SUMMARY OF THE INVENTION

The object of the present invention is to provide an improved electrodeless bulb.

According to the invention there is provided an electrodeless bulb comprising a hollow tube sealed at both ends and having a charge of excitable material, the bulb having a main portion and a reduced cross-sectional dimension, light emitting end portion.

Normally both the main portion and the end portions will have circular cross-sections, where their cross-sections will be circular and the respective dimensions diameters.

Whilst the reduced diameter portion can be tapered down in diameter from the main portion; preferably it is stepped down in diameter from the main portion.

Again whilst the reduced diameter portion can have a different shape, such as conical, it is preferably of constant cross-section, i.e. parallel sided.

The actual distal end can be flat or domed, with its shape being chosen in accordance with the desired pattern of light distribution from it.

Alternatively the reduced diameter end portion can be three dimensionally curved, for instance ellipsoidal or paraboloidal.

Whilst the reduction in diameter can be between 90% and 50%, preferably the stepped end will be between 4 and 5 sixths of the diameter of the main portion of the bulb.

Whilst the reduced diameter end can have the same wall thickness as the full diameter portion, in the preferred embodiment, the interior of the bulb is of constant diameter throughout its length.

Preferably, the bulb has a location leg or stem extending from its full diameter end.

Whilst the bulb can be of quartz as in our existing bulb, it can also be of ceramic material, such as alumina, aluminium nitride, yttrium aluminium garnet and artificial sapphire Preferably the charge is of metal halide and noble gas and this is normally indium bromide and xenon or krypton. Nevertheless, other volatile substances that are known to emit light when excited as a plasma can be used.

The bulb can be used in combination with an optical reflector having a focal point, the bulb being positioned with the focal point falling substantially on the central axis of the bulb within the reduced diameter portion. Preferably, the bulb is mounted in a ceramic waveguide, on which the reflector is positioned, and a microwave radiator is positioned within the waveguide and from which microwave energy is transferred via the waveguide to the bulb for its light emitting excitation in use.

BRIEF DESCRIPTION OF THE DRAWINGS

To help understanding of the invention, a specific embodiment thereof will now be described by way of example and with reference to the accompanying drawings, in which.

DETAILED DESCRIPTION OF THE PREFERRED EMBODIMENT

Figure 1:
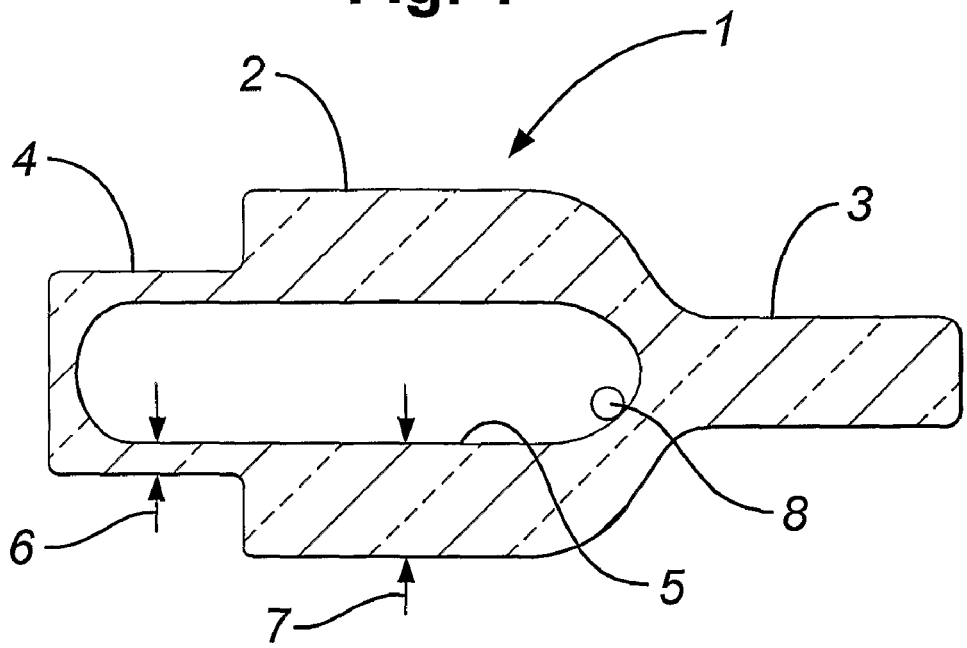
FIG. 1 is a cross-sectional side view of an electrodeless bulb of the invention.
Figure 2:
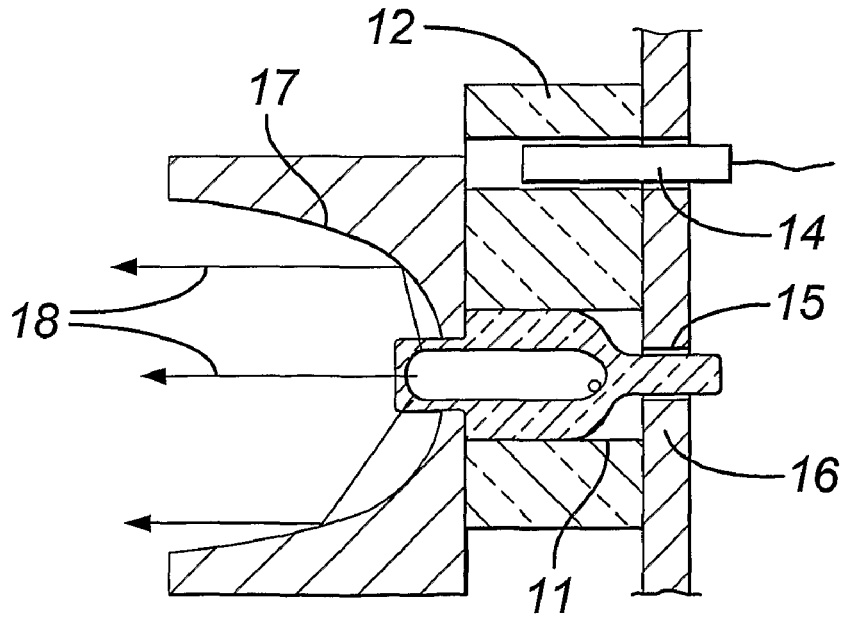
FIG. 2 is a diagrammatic view of the bulb installed in a wave guide with a reflector.

Referring to the drawings, an electrodeless bulb 1 has a hollow quartz tube 2, with a solid stem 3 extending from one end and a short hollow tip 4 extending from the other end. The hollow interior 5 of the tube extends into the tip 4 with the same diameter as in the tube 2, in other words the wall thickness 6 of the tip is reduced from that 7 of the main tube 2. The bulb is charged with an amount 8 of indium bromide and traces of other metal halides to adjust light spectrum and a filling of xenon gas.

In use the bulb is installed in a bore 11 in a ceramic wave guide 12 with a microwave feed 14. The stem 3 is received in a bore 15 in a metal backing plate 16. On microwave excitation of the bulb, a plasma forms in the xenon, which causes the indium bromide to vaporise and emit light.

Normally a plasma discharge lamp, such as our electrodeless bulb, will be provided with an excess of excitable material so that there is a maximum of the material in the gas phase during operation, thus maximising light emission. The corollary of this is that the material will tend to condense on the coolest part of the bulb. This condensate provides a reserve of the material. There can be disadvantage if the condensate forms at a point where light is being emitted. We had already discovered that by running the bulb with a short length extending from the ceramic wave guide, in order to be able to make use of some of the light emitted sideways, there is a tendency for development of a cool spot at this end, which impedes efficient emission of light.

We have now surprisingly found that by reducing the diameter of the tip of the bulb, it runs hotter with less tendency for development of a cool spot. It might be thought that a reduction in the diameter would tend to cause the tip to run cooler due to conduction of less heat to it. However, we think that the reduced surface area of the tip causes it to lose less heat and run hotter, bearing in mind that the light emitting plasma extends into the hollow of the tip.

Typical dimensions of the bulb are:

Diameter of main tube 2: 6.0 mm

Diameter of tip 4: 5.0 mm

Length of tube 2: 10.0 mm

Length of tip 4: 5.0 mm

Diameter of the stem 3 2.0 mm

Length of stem 3: 10.0 mm.

In FIG. 3 is shown a parabolic reflector 17, with the tip at the focal point of the reflector, whereby light from the tip is reflected in a generally collimated beam 18 from the reflector.

The above described preferred bulb has been formed by grinding the outer profile of the bulb and resulting in a reduced wall thickness, we now believe that the thermal performance of the bulb can be enhanced by reducing the wall thickness 7 of the main part of the bulb to that 6 of the tip, i.e. by providing the interior wide in the main part and narrow at the stepped end. Further in production, we anticipate that the bulbs will be blown in a mould.

The invention claimed is:

1. A lamp comprising in combination:

an electrodeless bulb, the bulb having:

a main portion;

a reduced cross-sectional dimension light emitting end portion;

a hollow tube located within the main portion, wherein the hollow tube extends into the reduced cross-sectional dimension light emitting end portion; and a ceramic wave guide having:

a bore for receiving the main portion of the bulb; and a microwave radiator positioned within the waveguide and from which microwave energy is transferred via the waveguide to the bulb for its light emitting excitation in use, the bulb being arranged in the ceramic wave guide with the reduced dimension portion extending out of the bore.

2. A lamp as claimed in claim 1, wherein the main portion and the reduced cross-sectional dimension portion have circular cross-sections, where their cross-sectional dimensions are diameters.

3. A lamp as claimed in claim 1, wherein the reduced cross-section portion is stepped down in diameter from the main portion.

4. A lamp as claimed in claim 1, wherein the cross-section portion is tapered down in diameter from the main portion.

5. A lamp as claimed in claim 1, wherein the reduced cross-section portion is parallel-sided.

6. A lamp as claimed in claim 1, wherein the reduced cross-section portion is conical.

7. A lamp as claimed in claim 1, wherein the reduced cross-section portion is three dimensionally curved.

8. A lamp as claimed in claim 1, wherein the reduced cross-section portion has a flat end.

9. A lamp as claimed in claim 1, wherein the reduced cross-section portion has a domed end.

10. A lamp as claimed in claim 1, wherein the reduced cross-section end is between fifty and ninety percent in diameter of the main portion.

11. A lamp as claimed in claim 1, wherein the cross-section diameter end is between four sixths and five sixths of the diameter of the main portion of the bulb.

12. A lamp as claimed in claim 1, wherein wall thickness of the tube is substantially constant between the main portion and the reduced cross-section portion.

13. A lamp as claimed in claim 1, wherein internal diameter of the tube is substantially constant between the main portion and the reduced cross-section portion.

14. A lamp as claimed in claim 1, wherein the bulb has a location leg or stem extending from its main portion end.

15. A lamp as claimed in claim 1, wherein the bulb is of quartz.

16. A lamp as claimed in claim 1, wherein the bulb is of ceramic material.

17. A lamp as claimed in claim 1, wherein the charge is of metal halide and noble gas.

18. A lamp as claimed in claim 17, wherein the metal halide is indium bromide and the noble gas is selected from the group consisting of xenon and krypton.

19. A lamp as claimed in claim 1, in combination with an optical reflector having a focal point, the bulb being positioned with the focal point falling substantially on the central axis of the bulb within the reduced cross-section portion.

* * * * *